US006224328B1

(12) United States Patent
Weigand et al.

(10) Patent No.: US 6,224,328 B1
(45) Date of Patent: May 1, 2001

(54) TURBOMACHINE WITH COOLED ROTOR SHAFT

(75) Inventors: Bernhard Weigand, Lauchringen; Conor Fitzsimons, Baden-Baden, both of (DE); Wolfgang Kappis, Mellingen; Hans Wettstein, Fislisbach, both of (CH)

(73) Assignee: Asea Brown Boveri AG, Baden (CH)

( * ) Notice: Subject to any disclaimer, the term of this patent is extended or adjusted under 35 U.S.C. 154(b) by 0 days.

(21) Appl. No.: 09/371,904

(22) Filed: Aug. 11, 1999

(30) Foreign Application Priority Data

Aug. 31, 1998 (DE) ..... 198 39 592

(51) Int. Cl.[7] ..... F01D 5/14
(52) U.S. Cl. ..... 415/115
(58) Field of Search ..... 415/1, 115, 116, 415/173.7, 175, 208.5

(56) References Cited

U.S. PATENT DOCUMENTS 4,668,162 * 5/1987 Cederwall et al. ..... 415/115
4,861,228 * 8/1989 Todman ..... 415/115
5,399,065 * 3/1995 Kudo et al. ..... 415/115
5,525,032 6/1996 Kreis et al. ..... 415/1

FOREIGN PATENT DOCUMENTS 44 11 616 10/1995 (DE) .
467346 * 12/1951 (IT) ..... 415/115

* cited by examiner

*Primary Examiner*—Edward K. Look
*Assistant Examiner*—James M McAleenan
(74) *Attorney, Agent, or Firm*—Burns, Doane, Swecker & Mathis, L.L.P.

(57) ABSTRACT

Turbomachine, in particular a compressor of a gas turbine, having rotor blades (11) and guide vanes (12), in which individual or all guide vanes (12) are configured as cooled vanes. The cooled vanes (12) have air guidance ducts (13) which emerge into outlet openings (14) in the region of the vane tips (15). Cooling air (K) is ejected through the outlet openings (14) and impinges at high velocity onto a rotor shaft (18). The cooling effect which can be achieved by this means is optimal and, in addition, leads to a raising of the compressor efficiency and the surge line.

13 Claims, 5 Drawing Sheets

Section A-A

TURBOMACHINE WITH COOLED ROTOR SHAFT

This application claims priority under 35 U.S.C. §§119 and/or 365 to German Patent Application No. 198 39592.2 filed Aug. 31, 1998 the entire content of which is hereby incorporated by reference.

BACKGROUND OF THE INVENTION

1. Field of the Invention

The invention relates to a turbomachine, in particular a compressor of a gas turbine.

2. Discussion of Background

In turbomachines with high thermal loading, in particular in the case of compressor stages of modern gas turbines, the rotor shaft is to be regarded as a particularly endangered component. As a consequence of the extreme temperature loadings, the life of conventionally used materials falls drastically so that additional measures have to be taken in order to deal with this problem.

A first approach to a solution consists in providing so-called heat shields which prevent direct contact between the heated flow medium and the rotor shaft and, by this means, should keep the heating within limits considered to be permissible. A disadvantageous feature is then the increase in the manufacturing costs and complexity of the turbomachine due to the additional components.

A further approach to a solution consists in manufacturing the rotor shaft from a material with improved high temperature behavior. Although such materials are available, problems arise in practical use due to a differing thermal expansion behavior as compared with the materials of adjacent components, in addition to increased material costs. Transient procedures in particular, such as, for example, the starting of the machine, introduce enormous difficulties due to the different time-dependent thermal expansion behavior.

Finally, it is also known to cool rotor shafts, made from conventional materials, by means of a central coolant hole which passes through the rotor shaft. Such a solution, however, is extremely cost-intensive and, in addition, not very effective.

SUMMARY OF THE INVENTION

The invention attempts to avoid the disadvantages described. Accordingly, one object of the invention is to provide a novel turbomachine, of the type mentioned at the beginning, which permits the rotor shaft to be cooled locally with a high level of effectiveness so that the life expectation of the rotor shaft is not appreciably impaired even in the case of extremely high thermal loading.

This is achieved, in accordance with the invention, by individual or all guide vanes being configured as cooled vanes which are fed from a cooling air supply. The cooled vanes are configured in such a way that air guidance ducts pass through them in the essentially radial direction and that they have outlet openings, which are directed onto the rotor shaft, in the region of the vane tips.

The advantages of the invention are of a manifold nature and relate to both technical design simplifications and aerothermodynamic aspects.

One of the main advantages of the invention may be seen in the fact that an optimum cooling effect can be achieved by directly subjecting the rotor shaft to cooling air. Even a relatively small quantity of cooling air is sufficient to hold the rotor shaft locally at a low temperature level. This last-named effect can be utilized in various ways.

It is, on the one hand, possible to use conventional, low-cost materials for the production of the rotor shaft even if a higher pressure ratio than previously is realized.

It is possible to dispense completely with heat shields even in thermally severely loaded high-pressure compressor stages because the rotor shaft can be cooled locally in a targeted manner.

Because of the high cooling effectiveness, it can be sufficient to design only individual guide vanes of a guide vane row as cooled vanes. In the normal case, however, all the rotor blades of a blading row are cooled because, in this way, it is possible to subject the rotor shaft to cooling air in an optimally even manner.

On the other hand, the life of the blading is increased because of the low temperature level effected by the cooling air. This affects not only the cooled vanes through which cooling air passes but also the downstream uncooled blading rows.

The compressor outlet temperature is also lowered overall so that the aerothermodynamic efficiency of the compressor is improved.

The cooling air emerging at the vane tips also effects an improvement to the fluid mechanics properties. Thus, on the one hand, kinetic energy is locally supplied to the boundary layer by the cooling airflow and has a positive influence on it. Given an appropriate design and arrangement of the outlet openings, on the other hand, the emerging cooling airflow prevents flow around the guide vanes in the gap between the vane tips and rotor shaft. Leakage losses in this region can therefore be avoided almost completely.

Because of the improvement to these aerothermodynamic relationships, the compressor also exhibits an improved operating behavior which is reflected by the surge line being clearly lifted.

The vibration behavior of the blading can be varied within wide limits by variation in the design parameters of the air guidance ducts, such as the number, dimensioning or location provided. This makes it possible to tune, within limits, the natural frequency and flutter characteristics in such a way that critical vibration conditions no longer occur.

The provision of the air guidance ducts at the guide vanes may, as a rule, be considered to be simple and inexpensive to configure because cooled vanes have to be provided, in particular, in the thermally highly-loaded rear stages of compressors and these guide vanes are not as a rule twisted or are only slightly twisted. The air guidance ducts can therefore usually be configured as simple holes which pass through the particular guide vane entirely radially or which branch off in an axial direction from a central air guidance duct.

The cooling device according to the invention has, in addition, the advantage that it can be very easily and precisely actuated. The cooling air can be extracted directly from upstream or downstream compressor stages but still requires preparation so that it can be fed in at a higher pressure and a lower temperature than those corresponding to the local condition parameters of the main flow. If a cooling airflow from a higher compressor stage is taken as cooling air, the cooling airflow must be cooled. If, on the other hand, the cooling airflow is taken from a lower compressor stage, this cooling airflow must first be further compressed externally and subsequently cooled.

The cooling concept according to the invention can be also applied with particular advantage in the case of guide vane rows with a shroud. The shroud permits the cooling film to be made even more uniform in the peripheral direction because the emerging partial cooling airflows are not immediately intercepted and entrained by the main flow.

Further preferred embodiments of the invention are directed toward simultaneously using the cooling air to influence the gap width between the guide vane tips and the rotor shaft. For this purpose, the cooled vanes are supported so that they can be displaced in the radial direction and are displaced from their initial position, against the action of return springs, by the pressure of the cooling air. This makes it possible to substantially raise the compressor efficiency and, in particular, the surge line. This effect is clearly marked in the case of modern high-pressure compressor stages because, in this case, large gap widths have to be provided, for safety reasons associated with the sluggish response behavior, in order to reliably prevent the vane tips from running into the rotor shaft.

The return springs represent a safety measure in case the cooling air supply should be interrupted. The cooled vanes return directly to their initial position and, in this way, increase the gap between the vane tips and the rotor so that, even when a severe radial expansion takes place for thermal reasons, the rotor cannot come into contact with the vane tips.

In accordance with an application of this concept which is particularly simple in design, the vane root of the cooling vanes is provided with a piston-shaped section which is guided in a sealed manner in a correspondingly shaped cylindrical casing section, thus forming a working space. The working space is in connection with the cooling air supply so that, when it is subjected to cooling air in the manner of a pneumatic cylinder, the cooled vanes can be pushed out.

The air guidance ducts of the cooled vanes are preferably in communicating connection with the respective working space, by which means the air guidance is of particularly simple design. The airflow fed in by the cooling air supply initially passes into the working space in each case and effects the radial displacement of the vane. From the working space, the cooling airflow now enters the air guidance ducts directly and leaves the vane in the region of the vane tip through the outlet openings. The geometry of the air-guiding duct sections and the pressure ratios in the compressed air supply are matched in such a way that the air jets emerging from the outlet openings have a high velocity and impinge at high velocity onto the rotor shaft arranged opposite to them. The impingement cooling realized by this ensures optimum heat transfer and, therefore, an optimum cooling effect for the rotor shaft.

Each two adjacent cooled vanes are advantageously firmly connected together and can be displaced while positively coupled together. This further simplifies the structural design of the support system without adversely influencing the cooling effect.

The air guidance ducts are preferably configured as holes, in particular as radial through-holes, this permitting the manufacturing outlay to be kept to a minimum.

Each of the cooled vanes preferably has a plurality of air guidance ducts extending, in particular, parallel to one another so that a plurality of partial cooling air jets can form at each of the cooled vanes. This permits the cooling of an axial section of the rotor shaft corresponding to the axial width of the respective guide vane row.

A similar effect can be achieved when a plurality of radially emerging outlet openings are respectively provided with access to a common air guidance duct. Such a solution is used, for example, in the case of those cooled vanes which are equipped to be displaceable by means of a piston-shaped section on the vane root and which therefore, for space reasons, do not permit a multiple arrangement of through-holes.

BRIEF DESCRIPTION OF THE DRAWINGS

A more complete appreciation of the invention and many of the attendant advantages thereof will be readily obtained as the same becomes better understood by reference to the following detailed description of embodiment examples of the invention when considered in connection with the accompanying drawings, wherein.

Only the elements essential for understanding the invention are shown; in some cases only abstract symbols, which make the function clear, have been used.

DESCRIPTION OF THE PREFERRED EMBODIMENTS

Figure 1:
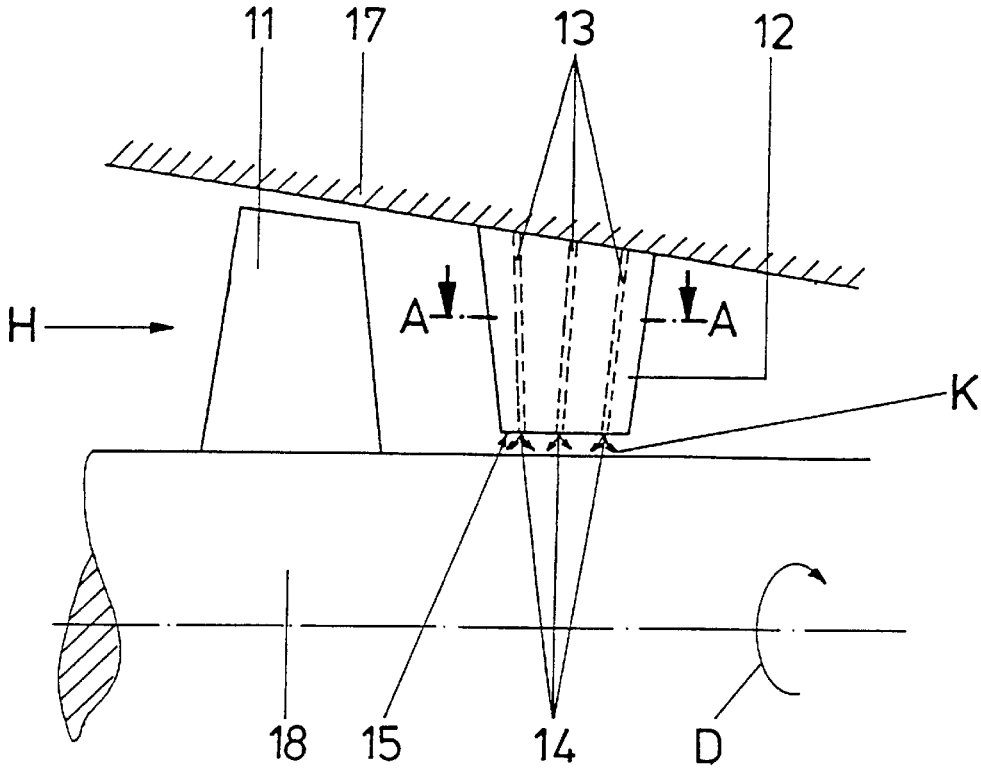
FIG. 1 shows a compressor stage in partial longitudinal section.
Figure 2:
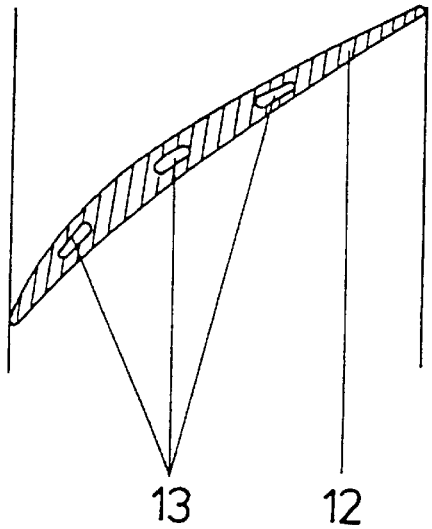
FIG. 2 shows a section A—A from FIG. 1 in enlarged representation.

Referring now to the drawings, wherein like reference numerals designate identical or corresponding parts throughout the several views, the rotor cooling concept on which the invention is based may, in particular, be seen in FIG. 1 and FIG. 2. A typical compressor stage of a high-pressure compressor with a rotor row and a guide vane row, symbolized by rotor blade 11 and guide vane 12, is shown. The rotor blades 11 are attached to a rotor shaft 18, which can be driven so as to rotate in the direction of rotation D, in a manner known per se.

Downstream of the rotor blades 11, there are guide vanes 12 which are fitted in known manner—and therefore so as to be stationary—on a casing section 17.

The guide vanes 12 are configured as cooled vanes. For this purpose, they have air guidance ducts 13, which extend continuously through the inside of the cooled vane 12 in the radial direction and emerge as outlet openings 14 in the region of the vane tip 15. The outlet openings 14 are directed onto the rotor shaft 18.

The air guidance ducts 13 are connected, in a manner not shown in any more detail, to a cooling air supply which supplies cooling air. The pressure is then selected in such a way that cooling air jets K emerge from the outlet openings 14 at high velocity and impinge on the immediately adjacent rotor shaft 18. The cooling effect achieved by this means is enormous because the heat transfer coefficient—and therefore the cooling energy which can be transferred—is very high.

As may be seen from FIG. 2, for example, the cooling air ducts 13 do not necessarily have a circular cross section.

Thus, for example, the cross-sectional shape can be optimally matched to the cross-sectional shape of the guide vane 12 section so that a high and optimally distributed air throughput can be realized. On the other hand, further advantages arise from the fact that the guide vane 12, or its surface around which flow occurs, is cooled from within. This also reduces the thermal loading on the guide vane 12, with the associated advantages of an extended life or the possibility of permitting a higher process temperature at the time of the design.

Figure 3:
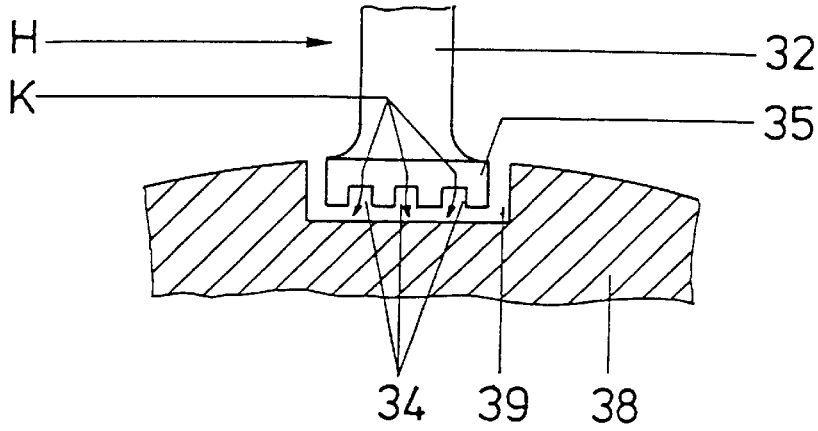
FIG. 3 shows an embodiment variant in partial longitudinal section.
Figure 4:
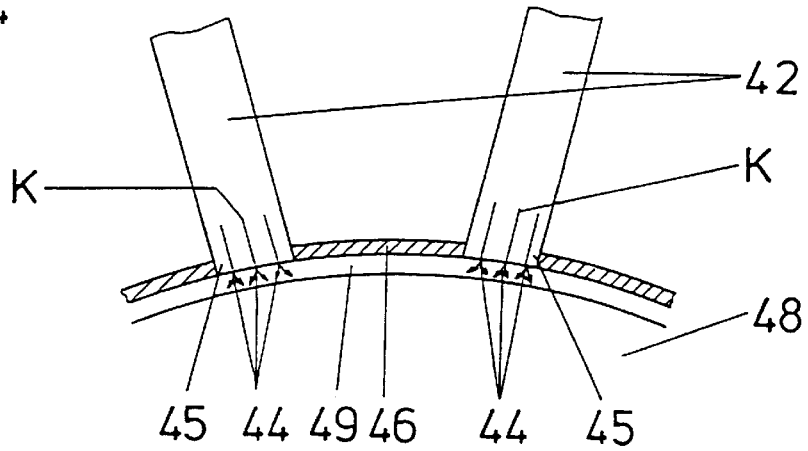
FIG. 4 shows a second embodiment variant in a partial view in axial section.
Figure 5:
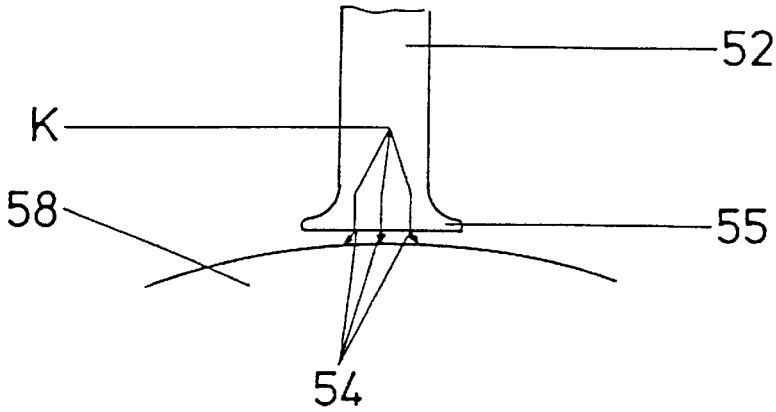
FIG. 5 shows a third embodiment variant in a partial view in axial section.

FIGS. 3 to 5 show various application variants in the specific application of the cooling concept according to the invention.

In the axial section to be cooled, a rotor shaft 38 has a peripheral groove 39 into which the vane tip 35 of a cooled vane 32 protrudes radially. Outlet openings 34, through which the cooling air jets K emerge, are in turn provided.

This configuration has inter alia the advantage that the emerging cooling air K is not immediately intercepted and entrained by the main flow H. In consequence, the local cooling effect is more strongly marked than, for example, in the case of the previously described configuration.

The embodiment variant shown in FIG. 4 has cooled vanes 42 which are connected to one another in the region of the vane tips 45 by means of a shroud 46. Outlet openings 44, through which the cooling air jets K emerge, are in turn arranged in the region of the vane tips 45. These cooling air jets impinge on a rotor shaft 48 directly opposite and cool the latter locally. A continuous annular gap 49 in the peripheral direction is present between the shroud 46 and the rotor 48 so that, in this case, there is also a certain retention effect for the emerging cooling air jets K.

In the embodiment variant of FIG. 5, cooled vanes 52 are present which have vane tips 55 which expand radially, in funnel shape, in the direction toward a rotor shaft 58. Outlet openings 54, through which cooling air jets K are ejected, are in turn provided in the region of the vane tips 55. The funnel shape of the vane tips 55 permits the rotor shaft 58 to be acted upon along a greater peripheral section than would be possible in the case of vanes which end in a radial straight line.

A common feature of all the above embodiment variants is that flow around the vane tips 15, 35, 45, 55 due to partial flows of the main flow H is to a large extent, or even completely, prevented by the emerging cooling air jets K. The surge lines of compressor stages cooled in such a way are therefore clearly higher than in the case of comparable compressors, without cooling device, from the prior art.

Figure 6:
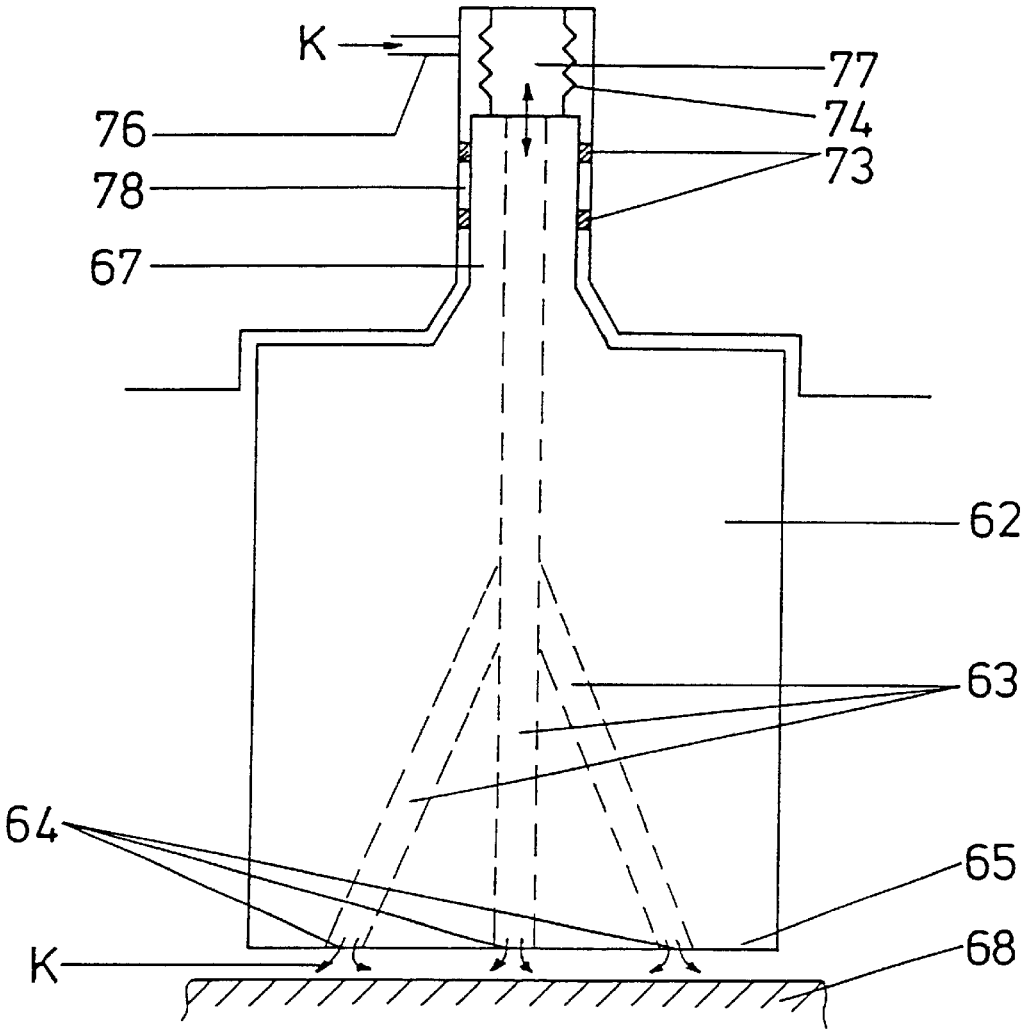
FIG. 6 shows a fourth embodiment variant with adjustable gap width in partial longitudinal section.
Figure 7:
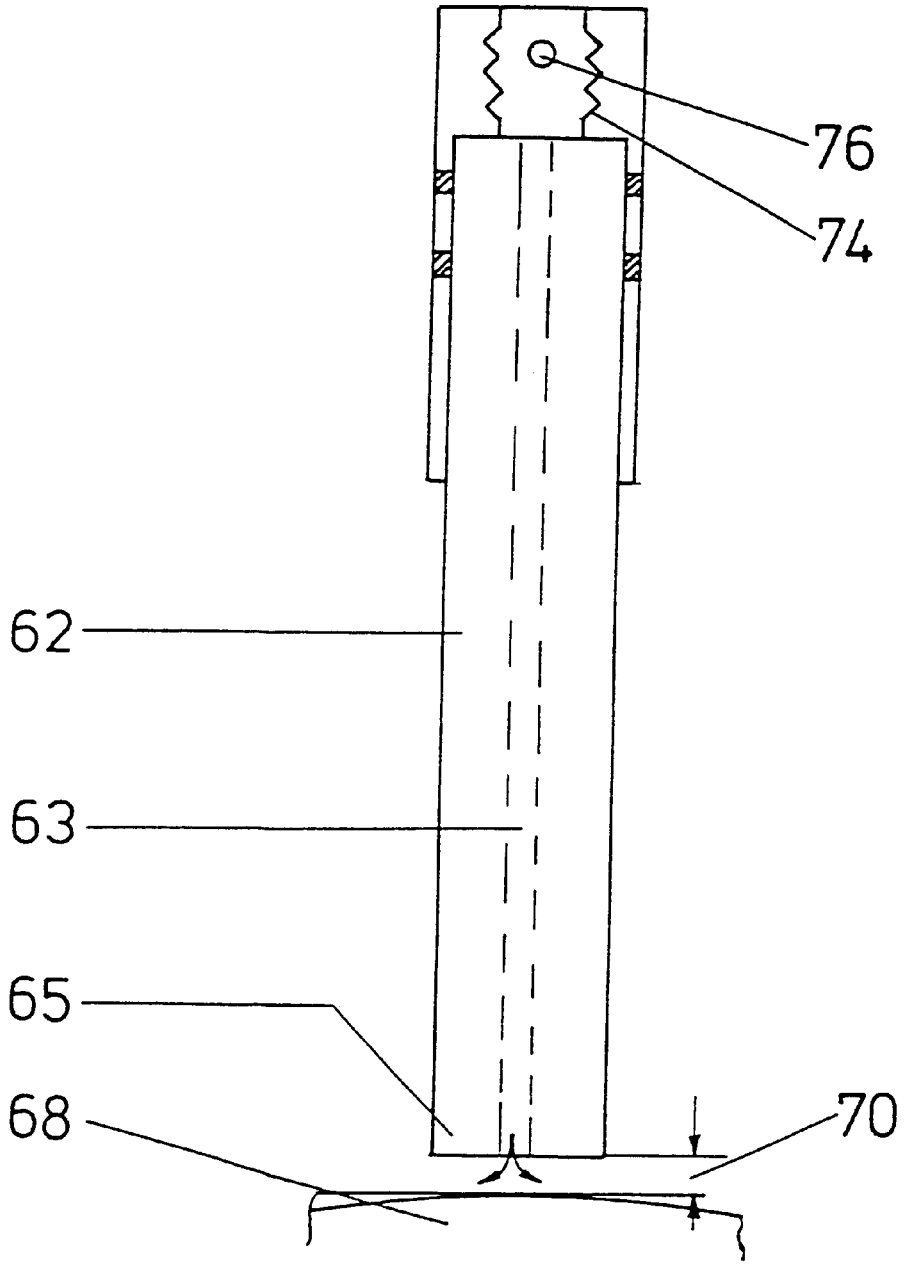
FIG. 7 shows a view from the left in accordance with FIG. 6.
Figure 8:
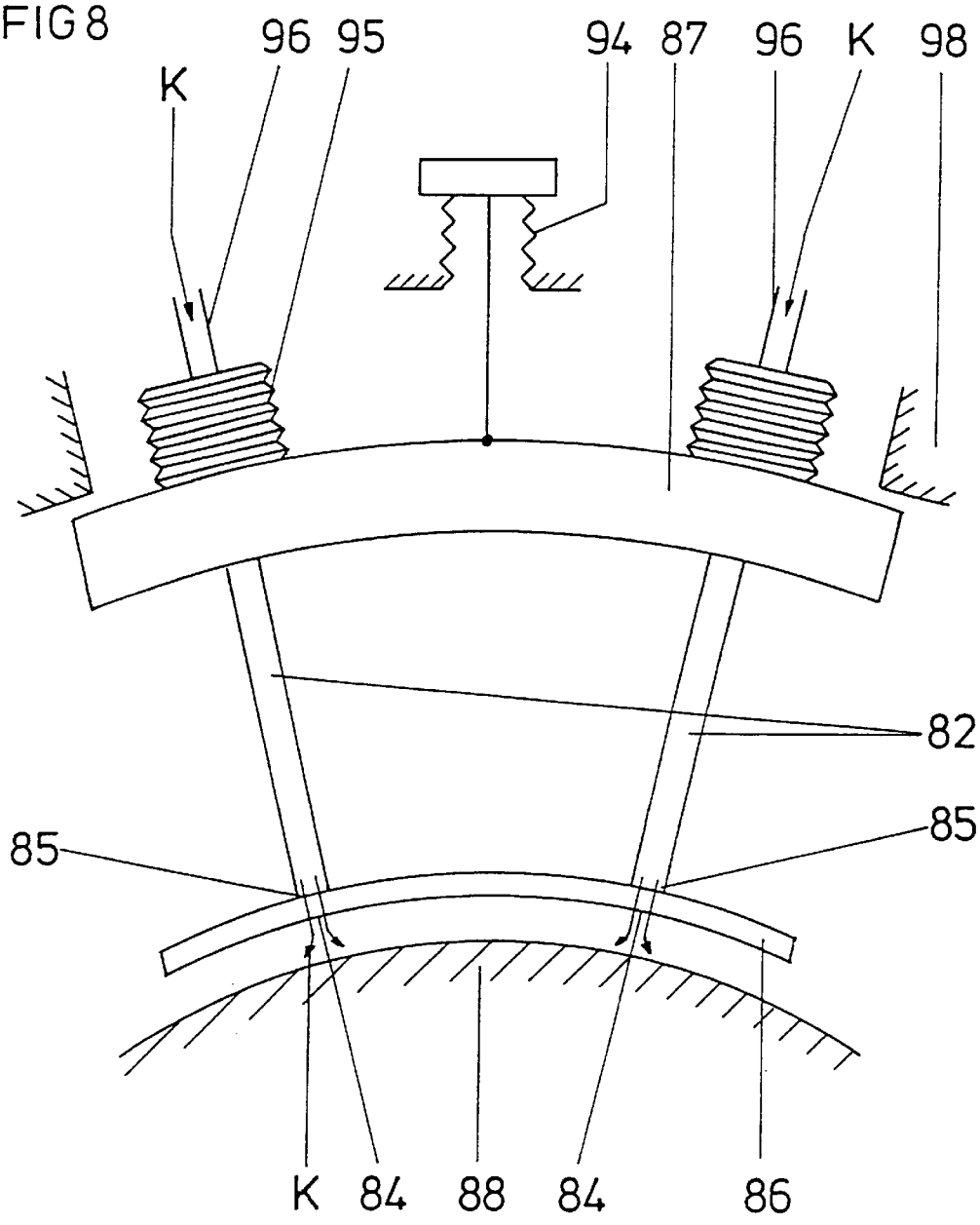
FIG. 8 shows a further embodiment variant with adjustable gap width in a partial view in axial section.

The embodiment variants as shown in FIGS. 6 to 8 permit a further rise in the surge line and a further increase in the compressor efficiency because the radial gap of the guide vane row can be adjusted, i.e. reduced, during operation.

In accordance with the embodiment variant shown in FIGS. 6 and 7, cooled vanes 62 have a vane root 67, of the type of a piston-shaped radial section, which is supported so that it can be displaced in a correspondingly shaped cylindrical casing section 78. A working space 77 is produced into which a supply duct 76 opens. Cooling air from the cooling air supply (not shown in any more detail here) is supplied to the working space 77 by the supply duct 76.

The vane root 67 is provided with sealing rings 73 so that, in this way, the working space 77 is sealed against the cylindrical casing section 78. As soon as the working space 77 is subjected to cooling air, the cooled vane 62 is displaced toward the rotor shaft 68. In addition, cooling air from the working space 77 enters the air guidance ducts 63 and leaves the latter through outlet openings 64. The displacement motion of the cooled vane 62 takes place against the action of return springs 74 which act, in the region of the working space 77, between the vane root 67 and the casing section 78. The return springs 74 have, on the one hand, the effect that they withdraw the cooled vane 62 when the cooling air supply is switched off and, in this way, a gap 70 is adjusted between the vane tips 65 and the rotor shaft 68 which is dimensioned sufficiently wide to reliably prevent the vane tip 65 from running into the rotor shaft 68. When the cooling air supply is switched on, on the other hand, the gap 70 is reduced to such an extent that an air cushion is formed in the gap 70 by the ejected cooling airflows K. This air cushion not only cools the rotor shaft 68 but also reliably prevents flow around the cooled vane 62 in the region of the gap 70. By this means, the compressor efficiency and the surge line can be raised in an optimum manner.

Given appropriate actuation of the cooling air supply, the width of the gap 70 can be made variably adjustable. A particularly simple design solution can, however, also be achieved by providing a stop (not shown in any more detail here) which limits the displacement path of the cooled vane 62 and therefore specifies the minimum width of the gap 70.

The variant shown in FIGS. 6 and 7 is further distinguished by the fact that each of the cooled vanes 62 of a guide vane row is supported so that it can be individually displaced. This configuration includes an additional safety aspect in such a way that in the case of a local fault at an individual cooled vane 62—for example due to blockage of the air guidance duct 63—the affected cooled vane 62 returns to its initial position. A thermal expansion in the radial direction, caused as a consequence of the lack of internal cooling of the cooled vane 62, does not lead to the vane tip 65 running into the rotor shaft 68.

The variant represented in FIG. 8 shows a tandem arrangement of two cooled vanes 82 on a common vane carrier 87. A shroud 86 is provided in the region of the vane tips 85. Cooling air jets K are again ejected from the cooled vanes 82 by means of outlet openings 84 and impinge on a rotor shaft 88.

As a departure from the embodiment examples described above, both cooled vanes 82 are, in this case, designed so that they can be radially displaced jointly. A return spring 94 acts directly on the vane carrier 87. A casing section 98 then acts as a rear stop for the vane carrier 87. The cooling air K is supplied separately to each of the two cooled vanes 82, a bellows 95 being respectively arranged as length compensation between a supply duct 96 and the vane carrier 87.

Obviously, numerous modifications and variations of the present invention are possible in light of the above teachings. It is therefore to be understood that within the scope of the appended claims, the invention may be practiced otherwise than as specifically described herein.

What is claimed as new and desire to be secured by Letters Patent of the United States is:

1. A turbomachine useful as a compressor of a gas turbine comprising:

at least one rotor row, at least one guide vane row, and at least one rotor shaft the guide vane row including at least one cooling guide vane each having a vane tip and at least one air guidance duct extending therethrough, the at least one cooling guide vane having at least one outlet opening in communication with the at least one air guidance duct, the at least one cooling guide vane being configured to receive cooling air fed by a cooling air supply, the at least one outlet opening being directed toward the rotor shaft adjacent the vane tip.

2. The turbomachine as claimed in claim 1, wherein the at least one guide vane is configured as at least one cooled guide vane.

3. The turbomachine as claimed in claim 2, wherein the at least one guide vane row further comprises a shroud.

4. A turbomachine useful as a compressor of a gas turbine comprising:

at least one rotor row, at least one guide vane row, and at least one rotor shaft the guide vane row including at least one cooling guide vane each having a vane tip and at least one air guidance duct extending therethrough, the at least one cooling guide vane having at least one outlet opening in communication with the at least one air guidance duct, the at least one cooling guide vane being configured to receive cooling air fed by a cooling air supply, the at least one outlet opening being directed toward the rotor shaft adjacent the vane tip;

wherein the at least one guide vane is configured as at least one cooled guide vane; and wherein the at least one cooled guide vane is supported to be displaced from an initial position by the pressure of the cooling air, and further comprising at least one return spring urging the at least one cooled guide vane toward said initial position.

5. The turbomachine as claimed in claim 4, further comprising a cylindrical casing section forming a working space, and wherein the at least one cooled guide vane includes a vane root having a piston-shaped section which is sealingly guided in the cylindrical casing section the working space being configured for fluid communication with the cooling air supply.

6. The turbomachine as claimed in claim 5, wherein the at least one air guidance duct is in fluid communication with the working space.

7. The turbomachine as claimed in claim 4, wherein the at least one cooled vane comprises two cooled vanes adjacent to each other, the two adjacent cooled vanes being firmly connected together and displaceable while positively coupled together.

8. The turbomachine as claimed in claim 1, wherein the at least one air guidance duct is a through-hole.

9. The turbomachine as claimed in claim 1, wherein the at least one cooling guide vane comprises a plurality of air guidance ducts extending parallel to one another.

10. The turbomachine as claimed in claim 1, wherein the at least one cooling guide vane comprises a plurality of outlet openings emerging at the tip of the at least one cooling guide vane.

11. The turbomachine as claimed in claim 5, wherein the at least one cooled vane comprises two cooled vanes adjacent to each other, the two adjacent cooled vanes being firmly connected together and displaceable while positively coupled together.

12. The turbomachine as claimed in claim 6, wherein the at least one cooled vane comprises two cooled vanes adjacent to each other, the two adjacent cooled vanes being firmly connected together and displaceable while positively coupled together.

13. A method for cooling a rotor shaft of a compressor of a gas turbine with rotor blades and guide vanes, at least one guide vane being configured as a cooled vane and having air-guidance ducts passing therethrough and having at least one outlet opening directed towards the rotor shaft adjacent the vane tip, comprising the step of:

feeding cooling air into the air guidance ducts;

passing the cooling air through the air guidance ducts;

discharging the cooling air through the at least one outlet opening; and impinging the rotor shaft directly with the cooling air.

* * * * *